United States Patent [19]

Coquerel

[11] 4,106,536

[45] Aug. 15, 1978

[54] SELF-ACTING DEVICE FOR STOPPING FILLING OF TANKS WITH FLUID PRODUCTS

[75] Inventor: Michel Jacques Léon Coquerel, Villerville, France

[73] Assignee: Equipment Industriel Normand, Grentheville, France

[21] Appl. No.: 724,937

[22] Filed: Sep. 20, 1976

[51] Int. Cl.[2] ..... B65B 57/14

[52] U.S. Cl. ..... 141/220; 141/229

[58] Field of Search ..... 141/192–229, 141/301, 302, 303, 39–64, 392

[56] References Cited

U.S. PATENT DOCUMENTS 3,165,128 1/1965 Hammond et al. ..... 141/220

*Primary Examiner*—Houston S. Bell

*Attorney, Agent, or Firm*—Imirie, Smiley & Guay

[57] ABSTRACT

A first secondary valve activated by a float controls through a differential pressure acting on a membrane a main valve in the tank filling duct. The first valve is automatically neutralized to ensure draining of the pipes placed upstream the main valve unless a second secondary valve prevents this neutralization if the level of the receiving tank is beyond a predeterminated level.

14 Claims, 10 Drawing Figures

115
19
11
41
39
37
105
17
21
81
97
31
55
43
33
73
53
35
13
61
15
71
23
67
69
63

C1
111
11
115
119
19
113
103.
39
41
105
17
51a
21
101.
87
91
93
21a
85
31
C2
89
45
37
43
33
83
95
53
35
55
81
97
13
15
57
59
61
73
65
23
69
63

SELF-ACTING DEVICE FOR STOPPING FILLING OF TANKS WITH FLUID PRODUCTS

Upon the decanting operations of a fluid from a cistern upon draining into a vat or a tank being filled, it is very often desired that the decanting operation does not cause an overflow of the fluid out of the receiving container. This is especially the case upon decanting of liquid fuels, contained in a transport cistern, into a stationary cistern, or, a storage tank such as a vat at a gas-station.

The transport cistern is generally provided with an outlet valve, whose control is not self-acting, and following said valve there are fixed draining pipes which are more or less flexible and whose volume can be relatively great.

There are already known devices with self-acting stoppage mounted downwardly the liquid on the cistern, the vat or, the storage tank, in which the flow of the liquid is stopped upstream the outlet-valve of the feeding tank by a main valve which is closed under action of a differential pressure applied to a membrane related with the main valve and coming from closing of a secondary valve by means of a float related with the level of the liquid in the container being filled.

There is also known, to palliate some deficiencies of the preceding devices, to use devices with self-acting stoppage of the filling operation preventing an overflow of the liquids upon filling of the tanks or storage vats, comprising a main valve placed in the filling duct of the tank or vat downstream the outlet valve of a cistern containing the liquid to be decanted, and a secondary valve which is closed when the liquid exceeds a first predetermined level under action of a float related with the level of the liquid in the tank or vat being filled, by generating a pressure which is applied to the main valve to close it, the action of the secondary valve having the possibility to be neutralized to ensure draining, into the storage vat, of the pipes located upstream the main valve due to a time-delay auxiliary valve, but neutralization of the secondary valve being made impossible because of the action, on a blocking valve, of a float related with the level of the liquid if the same exceeds a predetermined level.

In use of the above mentioned devices, it has been noticed that it was sometimes difficult to place the various control valves of the main valve as well as the necessary impulse pipes. Besides, the time-delay is sometimes a source of weakness. Also the unit was sometimes not easy to test or to change in case of deficiencies.

To cope with these disadvantages, the invention provides a device for a self-acting stoppage of the decanting operation, said device being placed on an upper filling inlet of a tank or vat, comprising a main valve, able to release or obturate the filling duct of the tank or vat downstream the outlet valve of a tank containing the liquid to be decanted, controlled by an upper membrane which can be submitted to a pressure on each of its sides, and a secondary valve, placed on a by-pass means of the liquid being decanted, which is closed under action of a float related with the level of the liquid contained in the tank or vat being filled when the liquid exceeds a first predetermined level by creating an overpressure on the upper side of the membrane fixedly connected to the main valve, by means of the flow of the liquid being decanted, which causes closing of the main valve, action of the secondary valve having the possibility to be neutralized to ensure draining into the vat or tank under filling of the pipes located upstream the main valve, said neutralization being made impossible if the level of the liquid in the vat or tank being filled exceeds a second predetermined level higher than the level setting into operation the secondary valve by the closing of a third valve under action of said float, and being characterized in that a port, located on the by-pass means of liquid provided with the secondary valve flowing directly into the vat under filling, creates, after the main valve is closed, a relative drop in pressure below an auxiliary membrane upwardly forming a chamber traversed by the liquid directed to the secondary valve, which brings said auxiliary membrane to control opening toward the tank being filled of a delivery-valve of the liquid forced-back on the upper surface of the membrane controlling the main valve by closing of the secondary valve, which causes reopening of the main valve, action of the delivery valve being neutralized by closing, under the action of the float related with the level of the liquid in the vat being filled, of said third valve which is downstream the delivery valve on a same by-pass means of the circuit of the liquid being decanted separate from the by-pass means controlled by the secondary valve.

Various other features of the invention are moreover shown in the following detailed description.

Embodiments of the invention are shown by way of non-restrictive examples in the accompanying drawings, in which.

Figure 1:
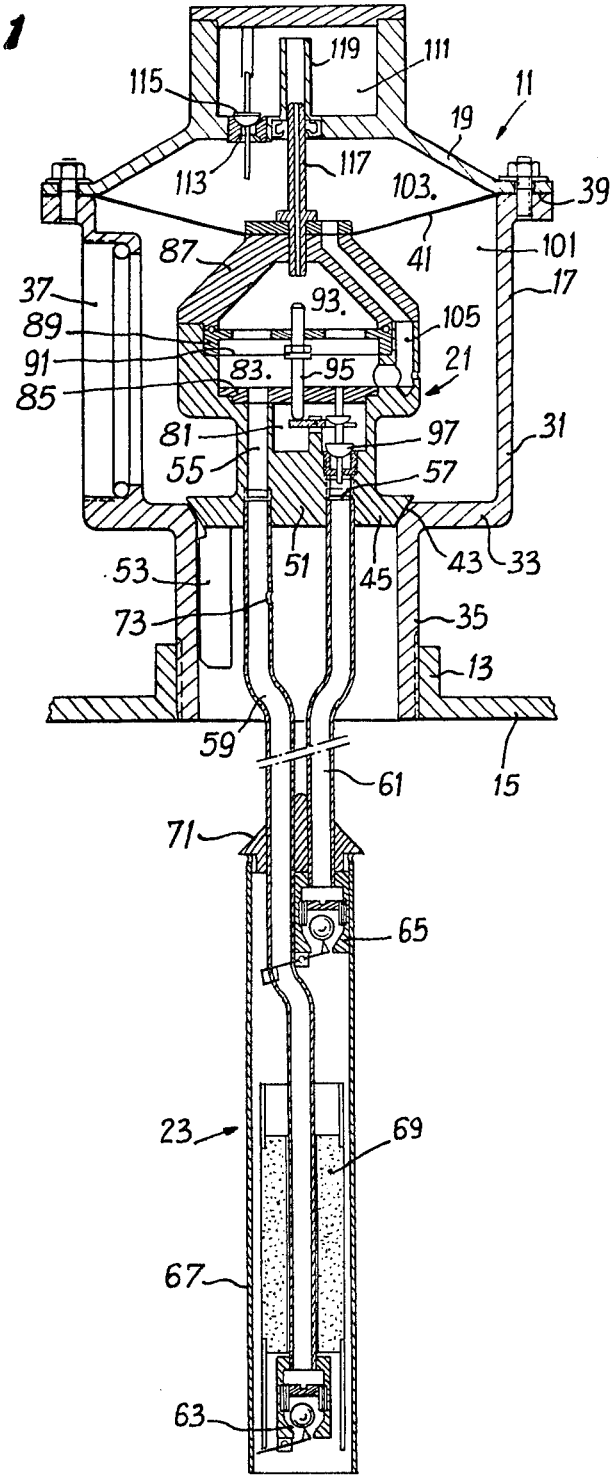
FIG. 1 is a cross-sectional view of the device of the invention in the standing-by position.

The self-acting device 11 for stopping the filling of tanks with fluid products, according to this invention, is shown as being screwed on a sleeve 13 welded at the upper portion of a tank 15, but many variants for fixing the device 11 are possible. The device 11 essentially comprises a body 17 topped by a cover 19 and a mobile unit 21 placed inside the body 17 supporting a control block 23 placed in the center of the tank 15.

The body 17 comprises, in the example described in FIG. 1, a cylindrical thimble-joint 31 extended, beyond a substantially flat bottom 33, by a tube 35 screwed into the sleeve 13. The body 17 comprises a lateral inlet 37 for the liquid, provided with components for connection of the body 17 to a pipe for the intake of the liquid (not shown). The thimble-joint 31 has a bearing surface 39 at its upper portion and a membrane 41 is mounted between the bearing surface 39 and a complementary bearing surface of the cover 19. The body 17 and cover 19 are fixedly connected by known means, for example bolts and nuts. At the junction between the tube 35 and bottom 33, the body 17 has a seat 43 on which bears a valve 45.

The base of the mobile unit 21 is formed of a block 51 having a circular outline and which supports at the lower portion thereof the valve 45 of a shape mating that of the seat 43. The valve 45 is extended by guide means 53 cooperating with the inner wall of the tube 35 to suitably drive movements of the mobile unit.

The block 51 is bored with two ducts 55 and 57 at the lower ends of which are fastened, in a known way, two tubes 59, 61 of which the lower ends are carrying valves 63, 65. The valve 63 is at a level lower than that of the valve 65. Both the valves 63, 65 are placed inside a protective casing 67. Inside the casing 67, there is a float 69, for example made of a porous material, guided by the lower portion of the tube 59 between the levels of the valves 63 and 65. The tubes 59 and 61 can be bent as bayonets, as shown on the figures, but various other arrangements are possible in other variants of embodiment. The casing 67 is topped by a protective cap 71 especially designed to protect the valves and the float from the impact of the liquid which flows down through the tubes 35. But a space or vents are provided between the cap 71 and the casing 67 to equalize the pressures between the inside and the outside of the casing 67 whatever the level of the liquid in the tank 15 may be. Then, the tube 59 is provided, at its upper portion and close to its insertion into block 51, with a port 73 of a small cross-section, the operation of which will be explained later on.

The block 51 of the mobile unit 21 is bored with an eccentric chamber 81 into which comes out the duct 57. Above the eccentric chamber 81 is positioned a chamber 83 whose general symmetry is that of the block 51. The separation between the two chambers 81 and 83 is made by a plate 85, fixed in a known way in the block 51. An upwardly tapered cover 87 is placed on the block 51, and between the block 51 and cover 87 is inserted a part 89 having edges pinching the periphery of a membrane 91 against a cooperating flange of the block 51. The membrane 91 separates the chamber 83 from an upper chamber 93 and is provided with a finger 95 which can control the opening of a valve 97 placed at the outlet of the duct 57 into the chamber 81. The finger 95 can be guided for example by aligned holes made in parts 85 and 89. Another hole is designed in the part 85 for inlet of the duct 55 into the chamber 83. On the upper portion of the mobile unit 21, i.e. on the upper portion of the cover 87, there is fixed in a known way the central portion of the membrane 41 whose peripheral portion is tightened, as above described, between the body 17 and the cover 19. The membrane 41 separates the space inside the body 17 and cover 19 into two chambers 101 and 103. The lower chamber 101 contains the main portion of the mobile unit 21 and the inlet 37 for the liquid comes freely therein. The chamber 103 is itself formed between the cover 19 and membrane 41.

In the thickness of the wall laterally surrounding the chambers 81 and 83 there is bored a duct 105 which freely comes into the chamber 83, the chamber 101 and the chamber 103.

Above the cover 19, a chamber 111 communicates with the chamber 103 by a port 113 provided with a valve 115. The mobile unit 21 is topped by a rod 117 which penetrates, in a tight way, into a guiding means 119 located inside the chamber 111.

The device of the invention operates as follows:

The device has been placed at the upper portion of a storage tank into which decanting operations have to be made. The port 37 has been provided with an inlet for the liquid (not shown). If there is assumed that it is desired to decant the liquid contained in a mobile cistern (not shown) provided with a delivery valve, then a line of pipes is placed between the cistern to be drained and the cistern 15. As long as the valve of the cistern to be drained remains closed, the device has its components in the positions shown in FIG. 1, with the main valve 45 bearing on its seat 43.

If the level of the liquid in the cistern 15 is rather low, both the valves 63 and 65 are open; if, on the contrary, the level of the liquid is too high, it is one of the conditions hereinbelow met upon filling. In case of FIG. 1, the float 69 bears on a lever lifting the closing component of the valve 63 above its seat; also a weight lifts the closing component of the valve 65 above its seat. Valves 97 and 115 are closed.

Figure 2:
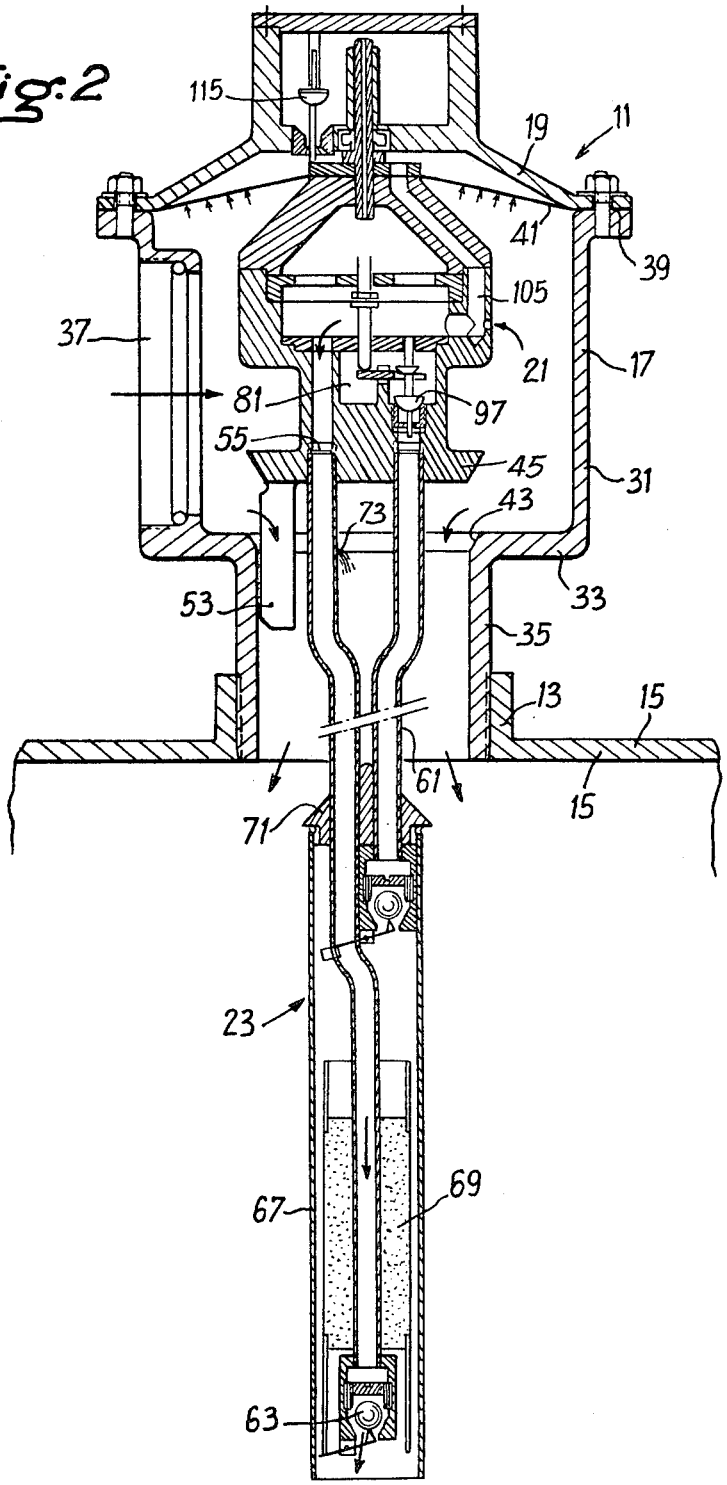
FIG. 2 is a cross-sectional view of the device upon the beginning of a decanting operation.

If the delivery valve of the cistern to be decanted is open, the liquid flows into the chamber 101 and lifts the mobile unit 21, partly due to action of the Archimedean thrust thereon and partly due to the pressure exerted by the liquid on the membrane 41. The valve 45 being lifted above its seat, the liquid flows through the tube 35 into the cistern 15. It can be noted that a small flow of liquid enters the duct 105, then the chamber 83 and flows through the tube 59 to exit both through the valve 63 and port 73. This is the state of the device shown in FIG. 2. Besides it should be noted that the valve 115 is lifted which permits a free communication to occur between the chambers 103 and 111.

Figure 3:
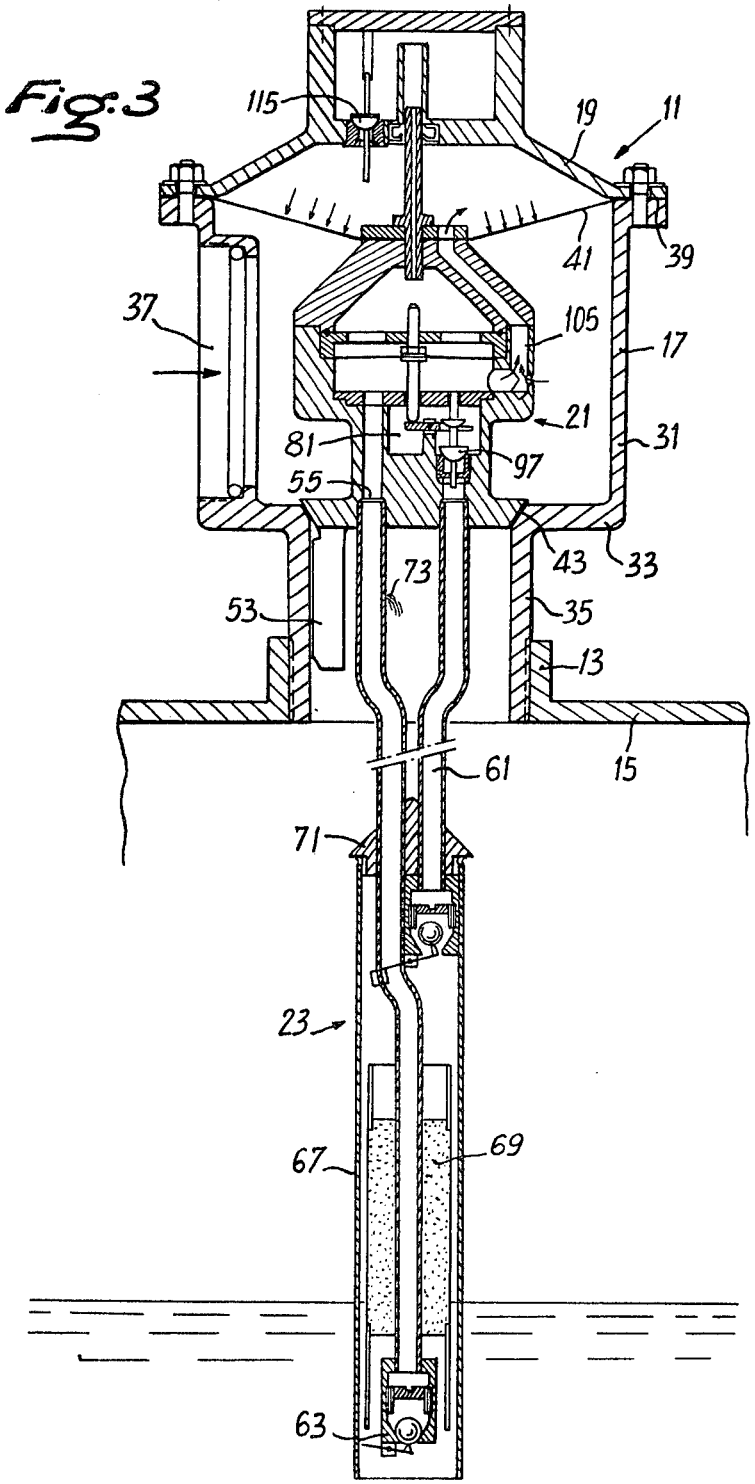
FIG. 3 is a cross-sectional view of the device at the moment when the level of the liquid in the tank reaches the first critical level.

When the level of the liquid in the cistern 15 is sufficiently high the float 69 is lifted by the liquid and consequently the valve is closed. The only flow remaining through the tube 59 relates to the port 73. Also, the level of the liquid goes up into the duct 105 and the liquid overflows into the chamber 103 and loads the membrane 41. The mobile unit 21 thus weighted moves down, the valve 45 applies on its seat 43 and the decanting operation stops. A portion of the liquid in the chamber 103 can penetrate into the chamber 111 since the valve 115 is initially lifted. Then the valve 115 is closed since it is no longer lifted by the mobile unit 21. Normally, since the decanting operation has stopped, the people in charge of the control of the decanting operation can close the delivery valve of the cistern to be decanted: this is the condition of the device shown in FIG. 3. It should be noted that there remains a flow of the liquid to be decanted through the port 73, fed by the volume of liquid which is upstream the main valve 45.

Figure 4:
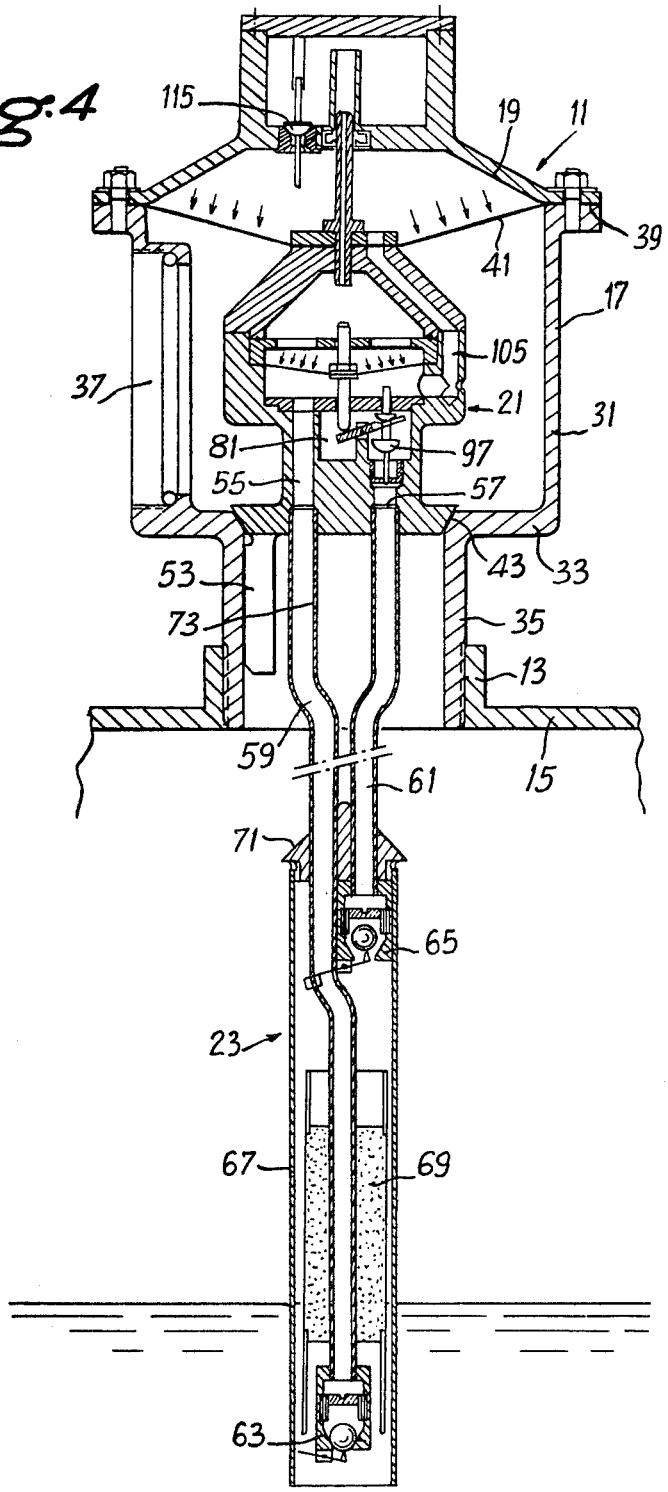
FIG. 4 is a cross-sectional view of the device when the relief port has started its operation to neutralize the first secondary valve.

As the liquid flows through the port 73, a certain drop in pressure lowering appears in the chamber 83, then the membrane 91 deviates downward and the finger 95 opens the valve 97, which causes a faster draining-off of the chambers 83 and 103 through the tube 61 and valve 65. This is the condition shown in FIG. 4. Normally, at that very moment, the people in charge releases the connection of the pipe bringing liquid on the draining-valve of the delivery cistern.

Draining of the chamber 103 permits lifting of the mobile unit 21 as during flowing of the liquid at the start of the decanting operation. The liquid can therefore flow again between the main valve 45 and its seat 43, the lower valve 63 nevertheless remaining closed. This step of the decanting operation is shown in FIG. 5.

Figure 5:
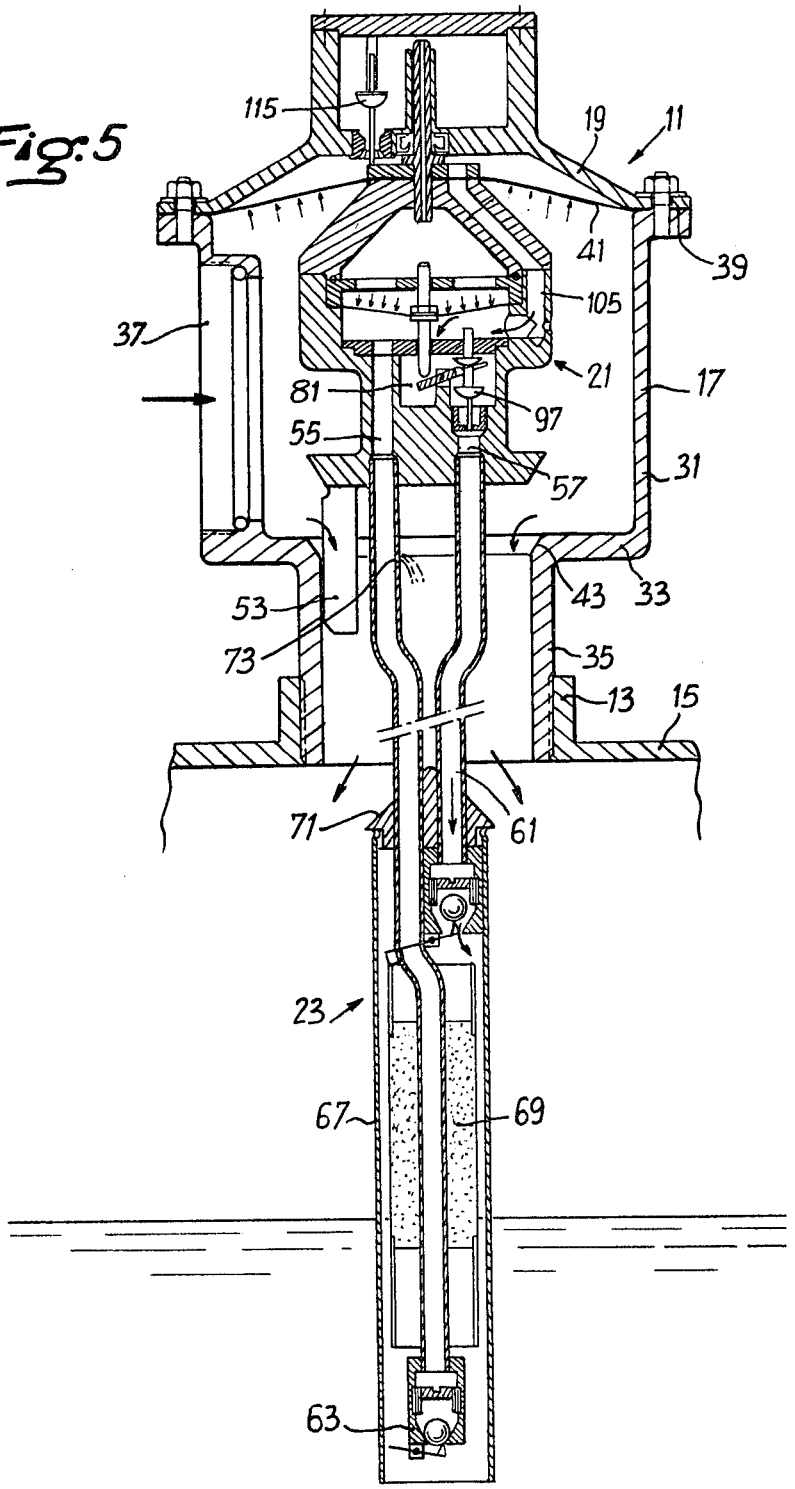
FIG. 5 is a cross-sectional view of the device when the main valve is lifted again to ensure draining of the upstream pipes.
Figure 6:
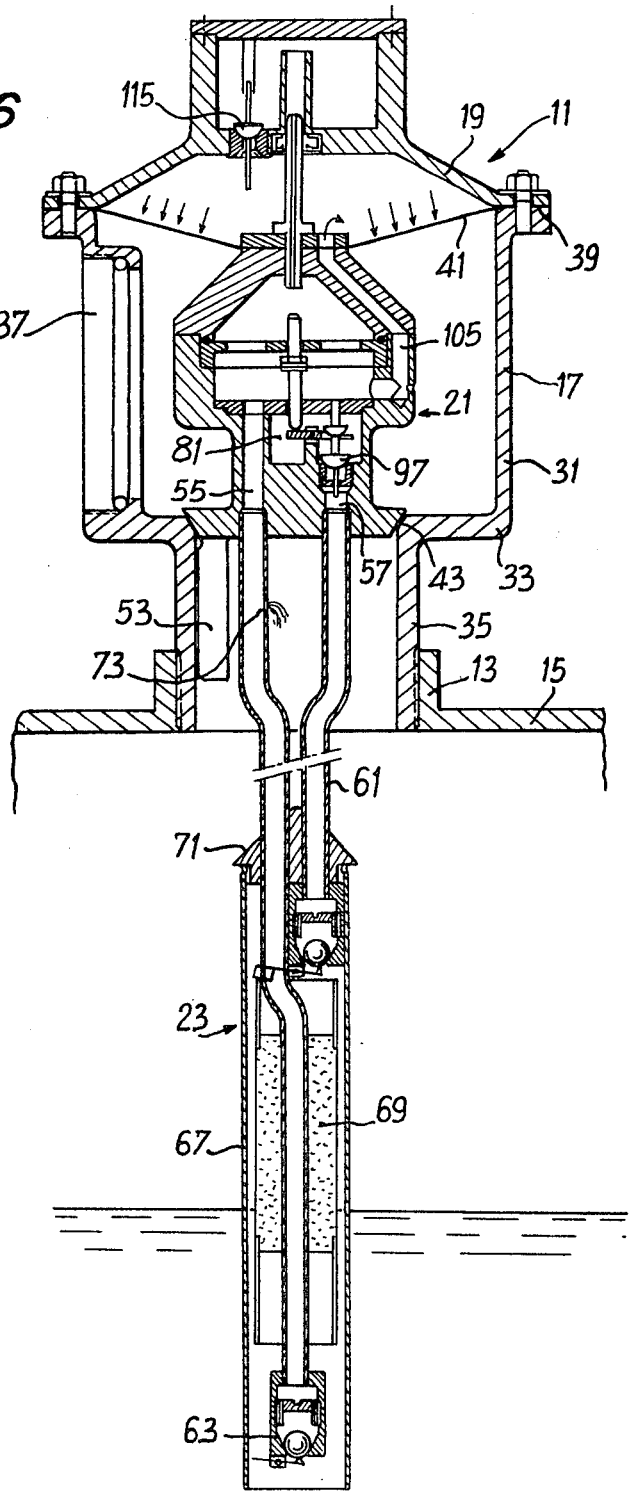
FIG. 6 is a cross-sectional view of the device when the second secondary valve ensures final stoppage of the decanting operation.

If, subsequently to the re-starting of the quick draining and as shown in FIG. 5, the raise of the float 69 causes closing of the valve 65, the liquid goes up again into chamber 103, which causes closing of the main valve 45. As the valves 63 and 65 are closed, the only draining which remains is that of the port 73 which is very small and could not, by itself, cause overflow of the cistern 15, but only after a rather long time.

Figure 7:
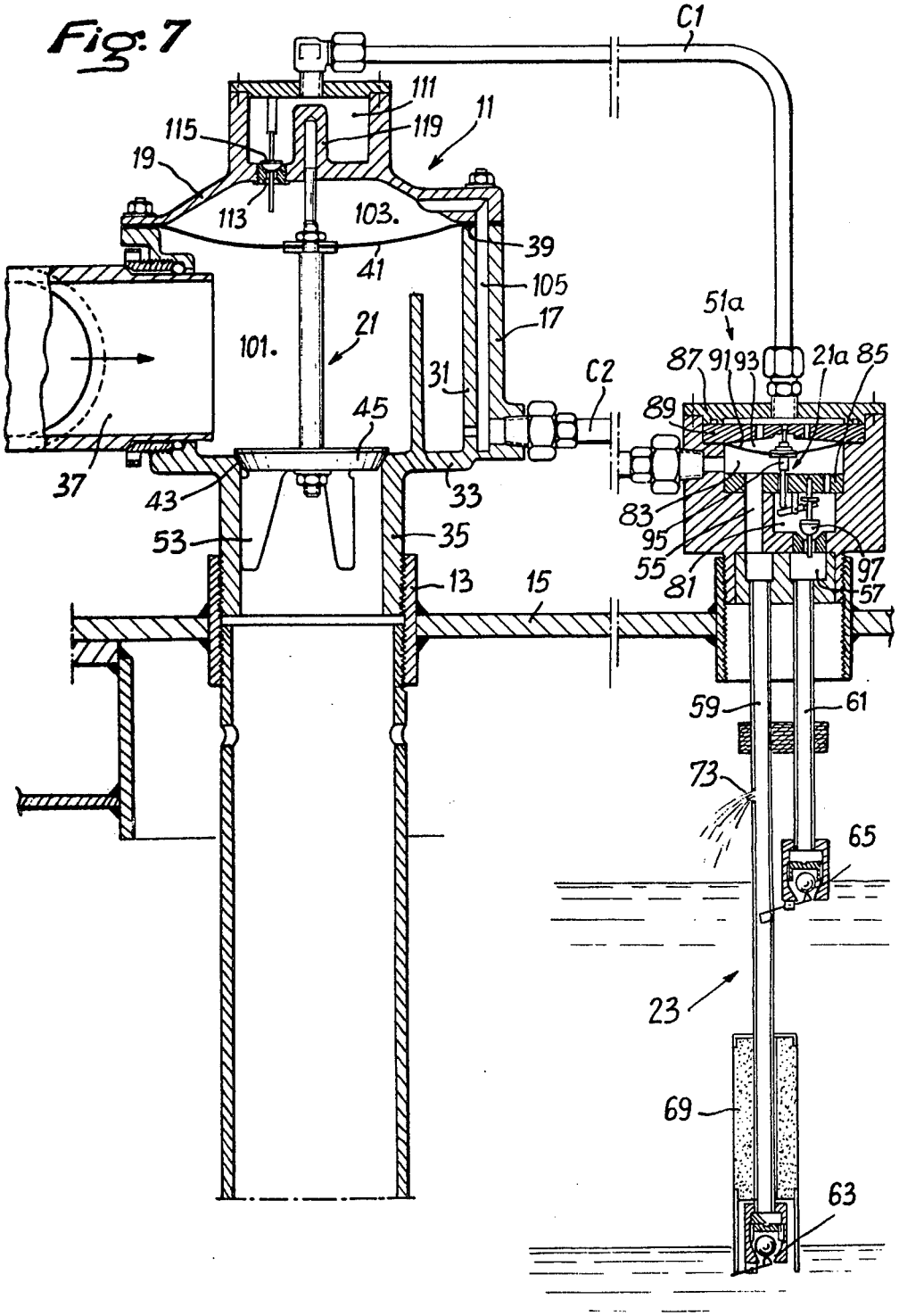
FIG. 7 is a second embodiment of the device of the invention.

In FIG. 7 there has been represented a second embodiment of the apparatus whose constitution is similar to the first one, but the main block for the decanting is separated from the self-acting unit 51*a*, 21*a* for the control of the level in such a way as to prevent, in some cases, a loss of pressure and therefrom a noticeable decrease of the filling flow delivery. In that second case, this risk is cancelled and, besides, the safety devices being out from the main flow, will not risk to be disturbed by this flow which is very important.

The reference numbers mentioned in FIG. 7 are that of FIGS. 1–6 since the elements are similar, and only two ducts $C_1$ and $C_2$ enable a junction of the main block with the safety device.

Figure 8:
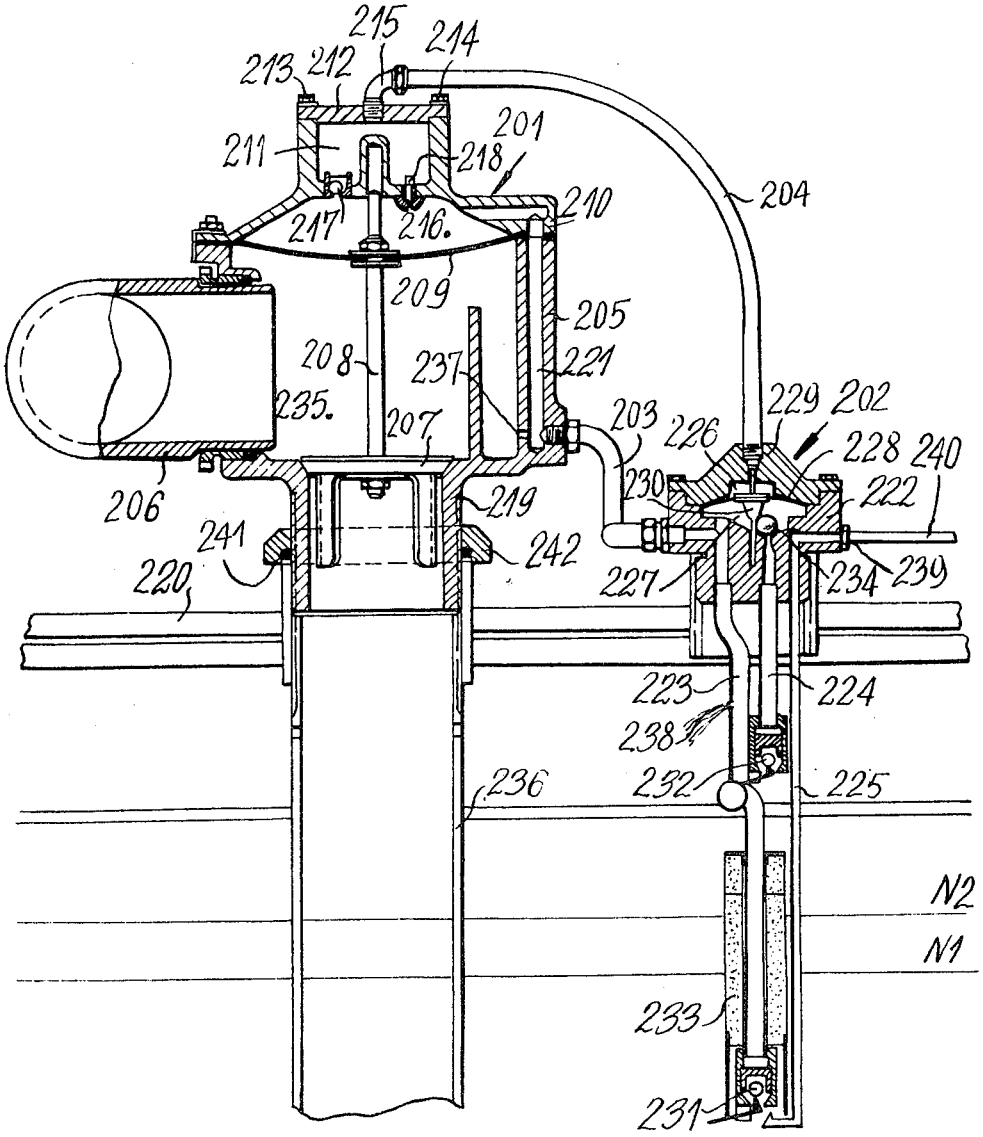
FIG. 8 is a cross-section of a third embodiment of the device.

The variant of embodiment shown in FIG. 8 has for its purpose to improve the filling limiting device as previously described, while bringing to it technical improvements while reducing the cost and to provide it with an additional device which enables the operation of the limiting device to be checked even when the vat is practically empty.

This improvement is obtained due to the fact that a compression chamber in the upper portion of the cover of the decanting head, communicating with a chamber formed above the membrane of this head through a valve and a nozzle, is connected by means of a flexible hose to a chamber, formed above the membrane of the control head; which membrane, through a needle and by means of a valve controls opening or closing of one of two plunger tubes supported by the control head. According to another feature of the invention, it is possible to check the good operation of the limiting device thanks to a tubular duct supported by the control head and which extends parallel to the two plunger tubes. The lower end of this duct is bent in such a way as to be directed towards the lower basin part of the float sliding on one of the two plunger tubes. The outlet pressure of a liquid injected into this duct causes the float to go up, whereby then simulating the presence of a liquid in the vat.

The limiting device as shown in FIG. 8 is constituted by two distinct elements 201, 202 which are connected to each other by means of two flexible pipes 203, 204 of a small diameter. The body 205 of the element 201, supporting the intake sleeve 206, contains the main valve 207 which is connected by a rod 208 having threaded ends, or by a similar component, to a membrane 209. This membrane is tightened with its peripheral edge between the body 205 and a cover 210.

At its upper portion, the said cover 210 has a chamber 211 whose top is obturated by a small cover 212, placed by means of screws 213, 214, and comprising in its center a connector 215 for a flexible pipe 204 connecting it to element 202. The chamber 211 communicates with the chamber 216 delimited by the cover 210 and membrane 209, on one hand, through the small valve 217 and, on the other hand, through the nozzle 218. The body 205 of the element 201, screwed or fixed by another way through the connection sleeve 219, preferably, in the plate 220 of the tank manhole, comprises, in one of its lateral walls a duct 221 which extends in the cover 210 and comes into the chamber 216. The element 202 which constitutes the control element is also fixed on the plate 220 of the manhole and comprises on its lower side three tubular ducts 223, 224 and 225 dipping inside the tank. The inner space of the element 202 is also divided into two chambers 226, 227 by a membrane 228, tightened between the cover 229 and the body 222, and connected by its center to a needle 230. The upper chamber 226 communicates by the flexible pipe 204 with the chamber 211 provided in the cover 210 of the element 201. The lower chamber 227 of the element 202 is connected, on one hand, to the duct 221 of the element 201 by means of the flexible pipe 203 and with the inside of the tank by means of the plunger tube 223 and, on the other hand, also connected with the inside of the tank by the plunger tube 224, whose length is smaller than that of plunger tube 223. Each of the lower ends of the tubes 223 and 224 is provided with a valve 231, 232. The valves are operated by a float 233 sliding on the tube 223. Another valve 234 is provided on the upper end of the tube 224 and is operated by needle 230 fixedly connected to the membrane 228. The tubular duct 225 comes or emerges beneath the float 233 and its lower end is directed onto the lower part of the float.

The operation of the device as shown in FIG. 8 is as follows:

When the level of the liquid in the tank is lower than level N1, the float 233 is in a low position thus the valves 231 and 232 are open, the valves 234 and 217 are, on the other hand, closed and the main valve 207 bears on its seat while tightly obturating the inlet duct of the tank. Now if the flexible pipe of the tank-waggon or cistern-truck is connected to the sleeve 206 and if the valve of the waggon or truck is open, the liquid arrives in the chamber 235 and exerts a pressure on the membrane 209 which causes the main valve 207 to be lifted and the liquid can flow into the tank through the plunger tube 236. A certain amount of liquid passes also through the plunger tube 223 by passing through a small hole 237 in the body 205 between the chamber 235 and the duct 221. As soon as the liquid in the tank reaches the level N1, raising of the float 233 causes closing of the valve 231, and the liquid having no longer the possibility to flow through the tube 223 goes up through the duct 221 and becomes accumulated in the chamber 216, where becomes established a pressure which is higher than that prevailing in the chamber 235. This pressure, by acting on the membrane 209, closes up the main valve 207 and the decanting operation is stopped. Due to the fact that valve 217 is open under the effect of the pressure, the pressure is the same in the chambers 235, 216, 211, 226 and 227, and will block the whole system as long as is retained, that is as long as the valve of the waggon or truck remains open and the flexible hose remains connected. This pressure P1 is a function of the height H1 of the liquid column comprised between the level of the liquid in the waggon or truck and the level of the body of the limiting device: $P1 = H1 \times$ density of the liquid.

Then when the valve of the waggon or truck is closed, for the purpose of draining the flexible hose, the pressure of the liquid in the chambers 235, 216 and 227 drops from P1 to P2 which causes closing up of the valve 217, thus the pressure P1 is maintained in the chambers 211 and 226. The pressure in the chambers 235, 216 and 227 is relieved by an exit hole 238 in the plunger tube 223. Under action of the pressure P1 acting on the membrane 228, the needle 230 drops down and controls the opening of the valve 234. Then if the flexible connection tube is disconnected between the waggon or truck and the tank, the liquid flows by the plunger tube 224 and through the exit hole 238 of the plunger tube 223. Due to that fact the pressure in the chamber 216 drops from P2 to P3, which will then permit lifting of the main valve 207 under action of the pressure P2 exerted on the lower side of membrane 209 by the liquid flowing during draining of the flexible hose. It should be noted that the pressure P2 is function of the geometrical height of the liquid column comprised between the level of the connector of the disconnected flexible hose and the level of the limiting device: $H2<H1$, thus $P2<P1$ ($P3<P2$). Due to the fact that the nozzle 218 enables a pressure lowering in the chambers 211 and 226, the valve 234 is closed and obturates the tubular duct 224. Since the tubular ducts 223 and 224 are closed, the liquid could go up through the plunger tube 223 and could cause closing of the main valve 207, as described above, but because of the exit hole 238 in the tube 223, and the draining speed in the flexible hose, the liquid has not time to accumulate on the membrane 209 in the chamber 216 and the main valve 207 remains open during the draining operation.

Once the decanting operation is over, the main valve 207 is closed under action of its own weight, and also the valve 217. The liquid contained in the plunger tube 223 flows through the exit hole 238 up to the level of the exit hole.

As the liquid is decanted by pumps, the float 233 goes down and causes opening of the valve 231. The limiting device takes again its stand-by condition.

The range between the level N1 and N2 is calculated in such a way as to enable draining of great length flexible hoses, such as that usually used for decanting of liquids. Consequently the unit will be drained before the liquid has reached the level N2.

If, due to an error, a new decanting step were tried when the level of the liquid is already between N1 and N2, and with the condition to have waited at least five minutes to enable the decanting circuit to be free from any pressure, the operation would be as follows:

The liquid which flows at a pressure P1 in the chamber 235 would open, in acting on the membrane 209, the main valve 207 and would fill the plunger tube 223 which is closed by the valve 231. Then the liquid would go up through the duct 221 and would accumulate in the chamber 216. The increase of the pressure in said chamber would act on the membrane 209 and would close the main valve 207. Since the above operations are instantaneous no overflow can happen and the level will not exceed N2.

When the liquid, upon the decanting step, reaches the level N2, the going up of the float 233 causes closing of the valve 232, and the plunger tube 224 is definitely closed. Due to the fact that the valves 207, 231 and 232 are closed and that the chamber 216 cannot be any longer lowered in pressure, the system is definitely blocked. The valves 232 and 231 will open only when the float goes down following the level of the liquid in the tank going down due to the draining by pumps. As soon as the liquid has reached the level N1, the limiting device is at a stand-by position.

In order to periodically check the good operation of the limiting device of FIG. 8, it is designed to provide the controlling head, constituted by the element 202, of a device which simulates the filling of the tank. This device is constituted by a mere tube of a small diameter 225 which extends, after passing through the body 222 of the element 202, parallel to the plunger ducts 223, 224 and has a lower end which is bent in such a way as to be directed on the bottom of float 233. The other end of the tube 225 supports on its exit from the body 222 of element 201, a sleeve 239 for connection of a duct 240.

When it is desired to check the operation of the limiting device, a liquid similar to that contained in the tank is injected under pressure into the pipe 240, 225 coming out under the lower part of the float 233. Depending on the adjustment of the pressure, the float 233 reaches the various levels required for the blank-tests.

Due to the fact that the limiting device of the invention can be mounted on the manhole cover of a tank or vat, positioning the device requires only minor work and is not costly. In view of facilitating positioning of the device of the invention on already existing installations, which is often the case, the body 205 of the element 201 is threaded on the whole height of the connection-sleeve 219, and blocking and tightness are provided by an adjusting-nut 242 and a toric joint 241.

Figure 9:
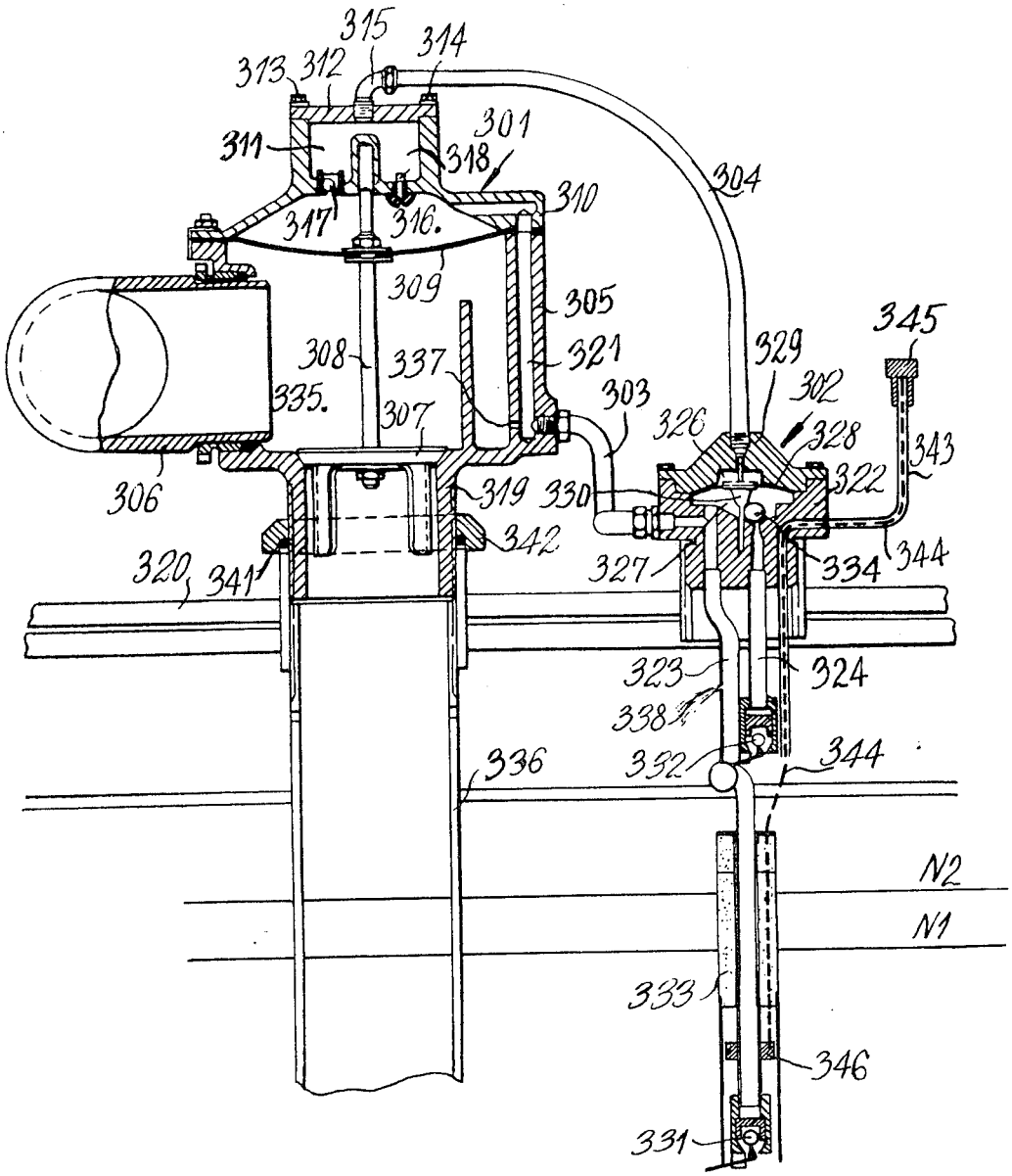
FIG. 9 is a partial cross-section of a fourth embodiment of the device.

FIG. 9 relates to a variant of the device to test the good operation of the self-acting limiting device for liquid containing vats.

The new device is constituted by a vertical tube placed on the body of the secondary valve supplying the differential pressure and in which is guided a pulling cable having one end connected to a milled cap obturating the tube inlet, the other end of the cable being fixed at a counterweight which can slide on the plunger tube of the secondary valve to make the float to go up while simulating the various filling levels of the tank by mere pulling on the cable.

The device of FIG. 9 is constituted by a vertical tube 343 which is fixed on the body 322 of the secondary valve 302 of the limiting device. This tube 343 is used as a guide for a pulling cable 344 having one end connected to a milled cap 345 which is screwed on the tube inlet, the other end of the cable being fixed to a counterweight 346 which can slide on the plunger tube 323.

The operation of the device of FIG. 9 is as follows:

When upon the delivery of a limited amount of liquids such as fuel, it is desired to check the operation of the limiting device, it suffices to unscrew the milled cap 345 of the control device and to pull the cable 344 by 2 to 3 cm. The float 333 is then lifted up to level N1 thus enabling the closing of the valve 331. The decanting of the tank of the truck or waggon then stops due to the fact that the liquid which cannot flow through the tube 323 goes up through the duct 321 and accumulates in the chamber 316 where is established a pressure which is higher than that in the chamber 335 and causes, in acting on the membrane 309, closing of the main valve 307.

It is then possible to check the draining of the flexible hose connecting the vat to the tank of the truck or waggon, by closing the decanting-valve on said tank and disconnecting the hose after waiting about 30 seconds. The liquid then flows through the plunger tube 324 and through the hole 338 of the plunger tube 323 and the lowering of pressure which results therefrom in the chamber 316 allows the lifting of the main valve 307 under the higher pressure in the chamber 335 acting on the membrane 309 due to the liquid entering during the draining of the flexible hose.

In order to check operation of the limiting device for the level N2, it is only necessary to pull the milled cap 345 gently as far as possible so that the counterweight 346, in taking up the float 333, controls the closing of valve 332. Due to the fact that the valves 307, 331 and 332 are closed and that chamber 316 cannot any longer be lowered in pressure the liquid cannot flow any longer and the decanting step is stopped as if the level N2 of the tank had been reached.

Once these checks are performed and to resume the decanting step, it is only necessary to screw again the milled cap 345, in a tight way, on the end of the tube 343 which causes the float 333 to go down again and the valve 331 to open again.

Figure 10:
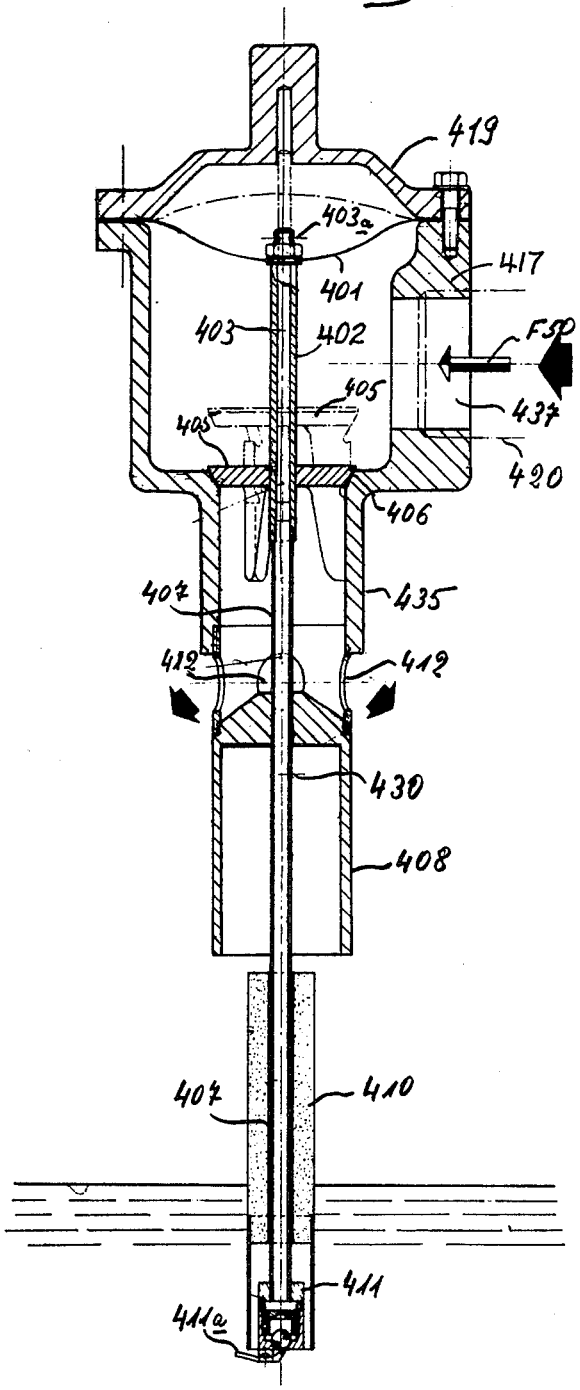
FIG. 10 is a cross-sectional view of another simplified embodiment of the device.

In FIG. 10, the device is placed on the vat as shown in FIG. 1. It essentially comprises a body 417 topped with a cover 419.

As previously the tube 435 is fixed by any suitable means on the vat to be filled. The main body 417 comprises a liquid inlet 437 equipped with the components which are necessary to the connection of said body to a pipe 420 for the intake of the liquid.

A membrane 401 which is held between the body 417 and the cover 419, supports in the center thereof a hollow tube 402 bored with a hole 403. The valve already described has the reference 405 and bears normally on the seat 406 provided at the lower portion of the body 417. The hollow tube 402 is extended through the valve 405 by a second hollow tube 407 centered relative to the tube 435. Said tube 407 also passes through baffle means 408 extending the tube 435 and finally supports, at the lower portion thereof, a float 410 sliding along the tube 407 which is normally closed by a valve 411.

The baffle means 408 is bored at its upper portion, near the tube 435, with holes 412.

The operation of the device is as follows: when the liquid, as for example a petroleum liquid fuel, comes through the pipe 420 into the chamber formed by the body 417, the pressure of the liquid lifts the membrane 401 which then is in the condition shown in dot and dash lines in FIG. 10. This motion of the membrane lifts the valve 405 and the liquid can flow through the tube 435, the baffle means 408 and the holes 412 in the vat. When the level of the liquid reaches the position shown in the drawing, the float 410 which had held open the valve 411 and thus let the liquid passing through the hole 403 flow through the tubes 402 and 407, stops the flowing of this liquid. At that very moment the liquid, passing through the duct 402, comes above the membrane 401 by the hole 403*a* and a pressure is established thus balancing the pressure in the chamber delimited by this membrane 401 as well as the pressure in the chamber delimited by the upper portion of this membrane. The balance of the pressures in the two above chambers enables the valve 405 to be closed under the effect of its own weight and also under the effect of the weight of its annex components.

The device is then closed.

The cock through which flows the liquid product is then closed (gun, valve of the tank of the truck or waggon delivering the product, etc . . . ). The liquid stored in the main body 417 and in the connexion hoses 420 flows slowly since the valve 405 has been able to be opened again slightly due to the fact that the pressure exerted by the liquid in the upper chamber above the membrane 401 is cancelled, the liquid having slowly flowed through a hole 430 bored in the tube 407. When the liquid in the delivery pipes has entirely flowed into the vat, the valve 405 is closed under action of its own weight.

I claim:

1. Mechanism for a self-acting stoppage of decanting operation of liquids from a filling tank to a vat to be filled, the tank comprising an outlet valve, the vat comprising an upper filling inlet, and the mechanism having an inlet port and an outlet port with a flexible pipe connecting the inlet port with the outlet valve of the tank and the outlet port being placed within the vat for flowing liquid therein, said mechanism comprising:

a body with an inlet and an outlet respectively communicating with said inlet port and outlet port, a flexible membrane mounted in the body and delimiting therein an upper chamber and a lower chamber, the lower chamber communicating with the inlet of said body, main valve means mechanically connected to the membrane and pendant therefrom to control opening of the inlet of said body whereby liquid coming from the filling tank through the outlet valve and the flexible pipe and the inlet port of the mechanism and the inlet of said body into the lower chamber raises the membrane and opens said main valve means, liquid then flowing through said outlet port in said vat, second valve means connected both to the lower chamber and to the upper chamber of said body and controling communication therebetween, a float placed in the vat for controling said second valve means at a first predetermined level in the vat, whereby when the liquid flowing in the vat through the main valve means reaches said first predetermined level, said second valve means is closed and causes liquid to flow from the lower chamber into the upper chamber so to balance the liquid on the flexible membrane which goes down with the main valve, said main valve being then closed and interrupting flowing of the liquid therethrough, third valve means mounted between the lower chamber and said outlet, and controled by the second valve means to be opened when both said second valve means and outlet valve are closed and the flexible pipe is dismounted from the filing tank, whereby liquid contained in the flexible pipe and in the lower chamber can flow into the vat.

2. Mechanism as set forth in claim 1, wherein means are further provided to control opening of the main valve when said third valve means is open.

3. Mechanism as set forth in claim 1, further comprising fourth valve means controlled by said float at a second predetermined level in the vat and connected to the third valve means to close said third valve means when the liquid in the vat reaches said second predetermined level.

4. Mechanism as set forth in claim 1, comprising a second upper chamber placed adjacent the upper chamber of said body, fifth valve means mounted between the second upper chamber and said upper chamber for controlling communication therebetween, the third valve means comprising a membrane upwardly forming a chamber with a tube mounted between said chamber and the upper chamber of said body.

5. Mechanism as set forth in claim 1, comprising means for adjusting said first predetermined level.

6. Mechanism as set forth in claim 1, comprising means for adjusting said second predetermined level.

7. Mechanism as set forth in claim 1, comprising means for checking the good working of the mechanism, said checking means comprising means to raise the float.

8. Mechanism as set forth in claim 7, wherein said checking means comprises a tube having a bottom part which is bent over and positioned under said float.

9. Mechanism as set forth in claim 7, wherein said checking means comprises a cable having one end conneced to an adjusting plug, the other end of the cable being connected to a block, said block being positioned under said float.

10. Mechanism for a self-acting stoppage of decanting operations of liquid, said mechanism being placed on an upper filling inlet of a vat and comprising:

a main valve able to control flowing of liquid in a filling duct of the vat downstream an outlet valve of a tank containing the liquid to be decanted, said main valve being controlled by a membrane subjected to a pressure on upper and lower sides thereof, a float operatively related with level of the liquid contained in the vat, a secondary valve placed on by-pass means of the liquid upon decanting, said secondary valve being closed under action of the float when the liquid exceeds a first predetermined level by creating an overpressure on the upper side of the membrane by means of the liquid upon decanting, closing of the secondary valve causing closing of the main valve, means provided to neutralize action of the secondary valve to permit draining into the vat under filling of the duct located upstream the valve, means provided to act on said neutralizing means to prevent the neutralization when the liquid in the vat exceeds a second predetermined level higher than the first predetermined level, said acting means comprising a third valve closed by the float at said second predetermined level, a port being located on the by-pass means of the liquid whereby liquid flowing directly therethrough into the vat under filling creates, the main valve being closed, a relative fall of pressure under an auxiliary membrane delimiting an upper chamber through which the liquid flows towards the secondary valve, a delivery-valve of the liquid forced back on the upper side of the control membrane of the main valve through closing of the secondary valve, said delivery valve being controlled by said auxiliary membrane to be opened towards the vat under filling, whereby causing a reopening of the main valve, means provided to neutralize action of the delivery valve by closing of the third valve under action of the float operatively related with the level of the liquid in the vat under filling.

11. Mechanism as set forth in claim 10, comprising a compression chamber communicating with a chamber formed above the membrane of the main valve through a valve and a nozzle, a control head provided with a secondary membrane, said compression chamber being connected by means of a flexible hose to a chamber formed above said secondary membrane, said secondary membrane controlling through a needle valve opening of a plunger tube.

12. Mechanism as set forth in claim 11, wherein said control head comprises a tubular duct which has a lower end which is bent in direction of the bottom of the float, whereby a liquid injected in said duct makes the float to go up thus simulating presence of a liquid in the vat.

13. Mechanism as set forth in claim 10, wherein the main valve is carried by a connection sleeve screwed on the upper filling inlet of the vat, said screwing being provided for facilitating height adjustment of the float, a nut and a toric joint ensuring a tight blocking of the sleeve on a manhole plate of the vat.

14. Mechanism as set forth in claim 10, comprising a tube having an outside intake and extending in the vat, a pulling cable being guided in this tube, said pulling cable having one of its ends connected to a milled cap screwed on the intake of the tube and another end fixed to a counterweight placed beneath the float whereby making the float to go up in simulating the various levels of the vat by a mere pull of the cable.

* * * * *